United States Patent [19]

Evans

[11] Patent Number: 4,667,818

[45] Date of Patent: May 26, 1987

[54] FITMENT ADAPTER FOR USE WITH CONTAINER

[75] Inventor: George D. Evans, Tustin, Calif.

[73] Assignee: Purex Corporation, Phoenix, Ariz.

[21] Appl. No.: 791,540

[22] Filed: Oct. 25, 1985

[51] Int. Cl.[4] ..... B65D 25/08; B08B 7/04

[52] U.S. Cl. ..... 206/219; 215/DIG. 8; 134/18

[58] Field of Search ..... 215/DIG. 8; 134/18; 206/219, 221

[56] References Cited

U.S. PATENT DOCUMENTS

| | | | |
|---|---|---|---|
| 4,024,952 | 5/1977 | Leitz | 215/DIG. 8 |
| 4,203,517 | 5/1980 | Hildebrandt et al. | 215/DIG. 8 |
| 4,304,869 | 12/1981 | Dyke | 215/DIG. 8 |
| 4,386,696 | 6/1983 | Goncalves | 215/DIG. 8 |
| 4,563,186 | 1/1986 | Fynn et al. | 206/219 |
| 4,606,775 | 8/1986 | Robinson et al. | 206/219 |

*Primary Examiner*—Joseph Man-Fu Moy

*Attorney, Agent, or Firm*—William W. Haefliger

[57] ABSTRACT

An adapter is provided in the form of a holder into which a fitment dispenser is removably received; the adapter is removably mounted on the neck of a capped container for removably suspending the dispenser within that neck. The adapter typically has frictional interfit with the dispenser which may be tubular. The container typically contains a first composition, and the fitment dispenser typically contains a second composition which is to be dispensed at the time access is gained to the first composition in the container via its neck, for use in cleaning process.

10 Claims, 8 Drawing Figures

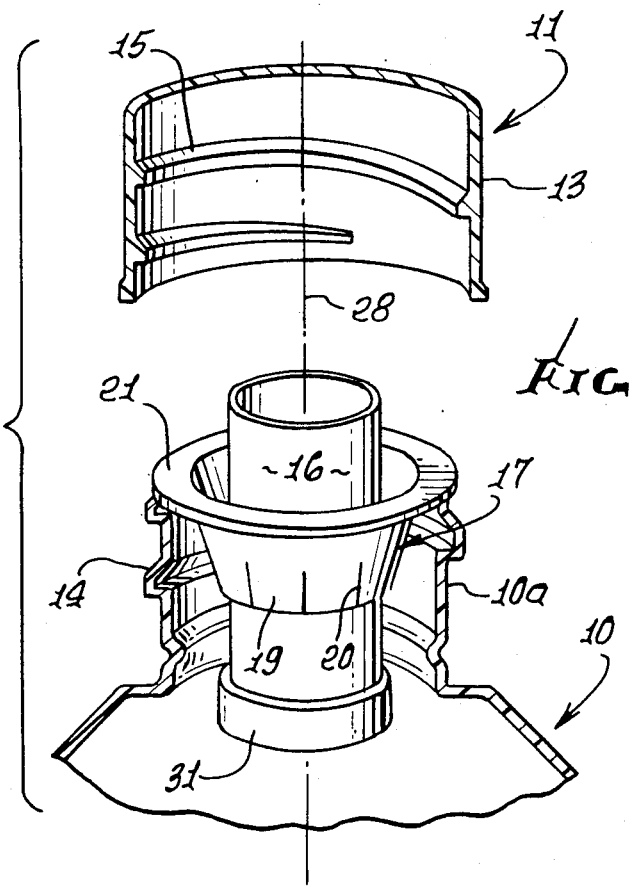
FIG. 3.
FIG. 5.
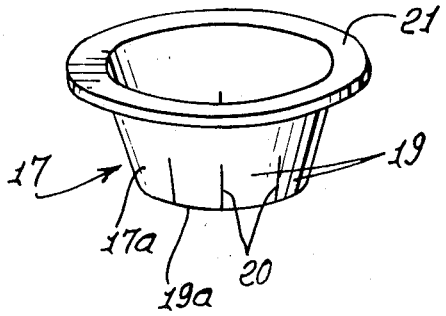
FIG. 4.
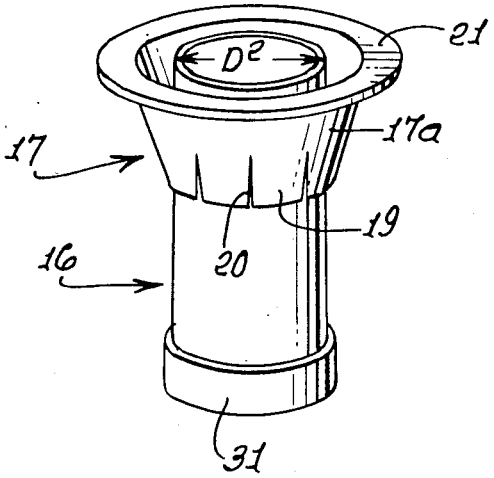
FIG. 6.
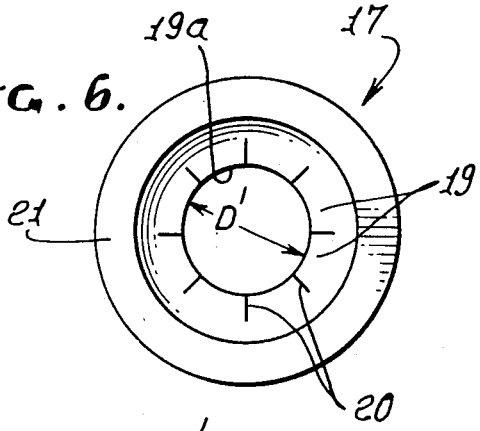
FIG. 7.
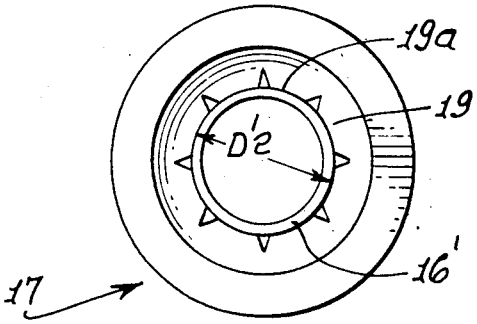

FITMENT ADAPTER FOR USE WITH CONTAINER

BACKGROUND OF THE INVENTION

This invention relates generally to systems usable in laundering or cleaning, and more particularly to a single package that incorporates a container for a first composition, and a fitment type dispenser for a second composition, the container and dispenser integrated into a single package for use of both compositions as in a cleaning or laundering process.

Typical two-component systems include: the provision of (1) surfactant composition in a container, and a prespotter composition in a dispenser, the latter composition usable on fabric prior to laundering in the wash water to which the surfactant is supplied; the provision of (2) a peroxygen bleach base in a container, and a bleach activator containing a halide salt in a dispenser and to be dispensed at the time of laundering; the provision of (3) a nonionic surfactant detergent in a container and an available chlorine compound in a dispenser to be dispensed at the time of laundering; and the provision of (4) a bleach base in a container and a bleach activator containing a halide salt, in the dispenser; and the provision of (5) a nonionic surfactant in a container, and a chlorine release agent in a fitment type dispenser, for dispensing use in a dishwasher.

See in this regard the folloiwng U.S. patent applications, the disclosures of which are incorporated herein:

(1) Ser. No. 597,127, filed Apr. 5, 1984
(2) Ser. No. 651,579, filed Sep. 17, 1984
(3) Ser. No. 597,025, filed Apr. 5, 1984
(4) Ser. No. 596,669, filed Apr. 4, 1984

The above applications disclose various forms of containers and fitment type dispensers, to be integrated in a single package. Such fitments are typically formed integrally with a bottle cap, or integrally with a support carried by the cap or bottle neck. There is need for a way to support the fitment so that it is not integral with either the cap or support, whereby it can be easily retrieved and manipulated, in and of itself, free of the cap and/or a support. There is also a need for a way to support various sized fitments.

SUMMARY OF THE INVENTION

It a major object of the invention to provide a fitment adapter meeting the above needs.

Basically, the invention contemplates the provision of a fitment in the form of a dispenser adapted for storage in the neck of a container for a first composition, to dispense a second composition therein at the time access is gained to the container interior, for use in a cleaning process, together with a cap configured to attach to the neck of the container. In this enviroment, the dispenser is located within the cap to project within the neck interior, and an adapter is provided in the form of a holder into which the fitment dispenser is removably received, the adapter removably mounted on the container neck and suspending the dispenser within said neck. Accordingly, when the cap is removed, the adapter may be removed from the container, and the fitment dispenser quickly and easily removed from the adapter, for ease of manipulation and use of the dispenser in and of itself, at the time of laundering. If desired, the dispenser is then easily and quickly remounted in the adapter, and the latter replaced in the container, after which the cap is replaced on the neck.

In addition, the adapter is typically generally annular and said fitment is tubular and has slidable and frictional interfit with the adapter; and the adapter may have fingers which slidably interfit the dispenser. The adapter further may advantageously have a frusto-conical portion defining said fingers, there being slits between the fingers; and the fitment may form external grooving to receive edges of the fingers thereby to stabilize the fitment relative to the adapter.

More specifically, the adapter typically extends generally vertically, and the adapter fingers project downwardly and toward the adapter for slidable interfit therewith; and the adapter has an upper rim portion that is retained between the cap and the top portion of the neck. In this regard, the top of the adapter typically extends adjacent a top wall defined by the cap when the cap is secured on the neck.

The dispenser itself may be tubular and have a closure at one end thereof to be removed for dispensing said second composition. Such a dispenser may contain, for example, one of the following, as referred to in the BACKGROUND:

(i) a pre-spotter composition
(ii) a bleach activator composition
(iii) available chlorine compound
(iv) bleach activator (includes halide salt)

A cleaning process according to the invention includes the steps:

(a) providing a first volume of a first composition in a container,
(b) providing a second and smaller volume of a second composition in a dispenser in close transported association with said first volume for presentation at the time of cleaning,
(c) removably mounting said dispenser in an adapter and removably mounting the adapter on the first container, in an opening of the first container from which first composition is pourable,
(d) and separating some of said first composition from said dispenser for use in conjunction with said first composition at the time of cleaning,
(e) said (d) step including removing said adapter from the first container and removing the dispenser from the adapter.

These and other objects and advantages of the invention, as well as the details of an illustrative embodiment, will be more fully understood from the following specification and drawings in which:

DRAWING DESCRIPTION

Figure 1:
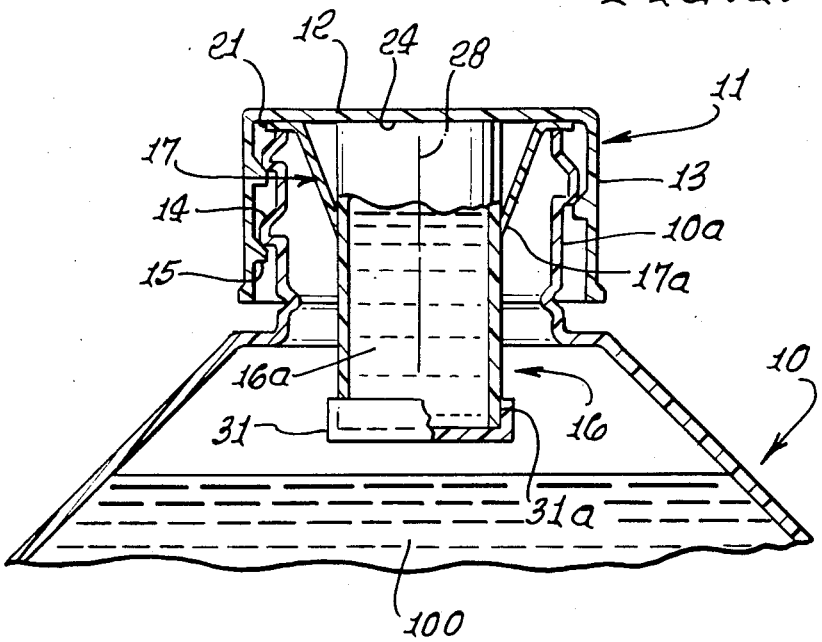
FIG. 1 is a vertical section showing a dispenser fitment retained by an adapter in a bottle cap, attached to a bottle neck.
Figure 2:
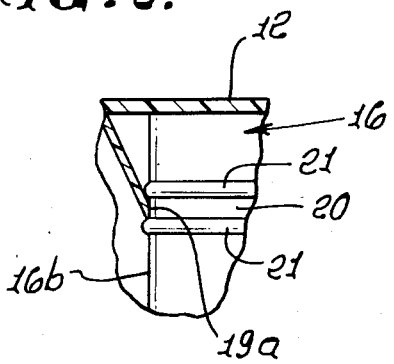
FIG. 2 is a fragmentary elevation showing a modified connection of the fitment to the adapter.
Figure 2A:
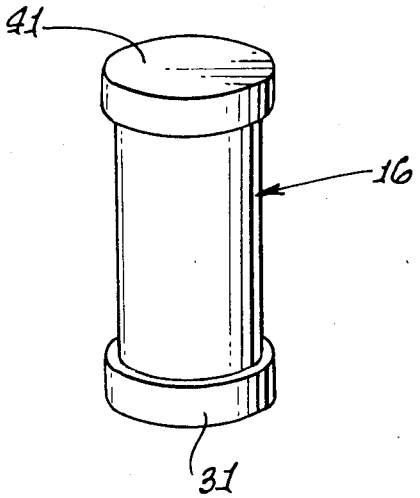

FIG. 2*a* is an elevation showing a fitment modification;

FIG. 3 is an exploded perspective view of the elements seen in FIG. 1;

FIG. 4 is a perspective view of the fitment dispenser retained by the adapter;

FIG. 5 is a perspective view of the adapter alone;

FIG. 6 is a top plan view of the adapter; and

FIG. 7 is a top plan view of the adapter receiving a larger diameter fitment dispenser.

DETAILED DESCRIPTION

Referring first to the drawings, FIG. 1 illustrates a container in the form of a bottle 10 having a threaded neck 10*a*, the bottle containing flowable detergent 100 (as for example liquid detergent or flowable dry granules). The bottle has a removable cap 11 which in turn has a top horizontal wall 12 overlying the neck 10*a*, and a depending skirt 13 that extends in interfitting relation with the neck. As shown, the skirt and neck have interfitting screw threads 14 and 15, other type connections being usable. The bottle, neck and cap may all consist of molded plastic material.

Also provided is a dispensing container as defined by fitment 16 containing a first composition 16*a*, for use in a cleaning process. One such composition is a fabric pre-spotter as disclosed in said application Ser. No. 597,127. Other compositions will be referred to. The fitment is carried to be readily detachable, at least in part, for dispensing the first composition, as onto fabric as at the time of fabric laundering. Thus, for example, removal of the cap 11 to provide access to detergent 100 in the container immediately presents the user with the fitment projecting in the neck 10*a* reminding the user that the fitment is ready to be used for application of pre-spotting composition to heavily soiled portions of the fabric, as at the precise time of laundering and in conjunction therewith, to obtain a resulting higher quality cleaning of the fabric.

The dispenser fitment 16 is shown as tubular, and removably retained in position within the cap to project within the neck interior. For this purpose, an adapter 17 is provided in the form of a holder into which the fitment dispenser is removably received, and the adapter is, in turn, removably mounted on the container neck 10*a*, whereby the dispenser 16 is suspended within that neck. When the cap 11 is removed from the container, the adapter and the dispenser 16 are removable as a unit, or separately, from the neck so that the bottle contents 100 can be poured from the bottle. Also, the fitment dispenser is easily removable from the adapter while it remains mounted on the neck, or after it is lifted from that position, whereby the fitment dispenser is then easily manipulated entirely by itself, to dispense its contents.

As shown, the adapter 17 is generally annular, and has a lower frusto-conical portion 17*a* that tapers downwardly and inwardly toward central vertical axis 28. Lower portion 17*a* has fingers 19 (see FIG. 5) separated by circumferentially spaced slits 20 extending along the slant height of the lower portion 17*a*. The lower edges 19*a* of the fingers slidably and frictionally interfit the exterior surface of the tubular dispenser. FIG. 6 shows the undeflected edges 19*a* as forming a circle of diameter $D_1$. Typically, the tubular dispenser has a diameter $D_2$, where $D_2 > D_1$, so that the fingers 19 are slightly spread, or deflected, whereby the spring fingers grip the surface of the dispenser to hold it in position. FIG. 1 shows this condition; and FIG. 2 shows the dispenser surface 16*b* as having a shallow annular groove 20 formed as between two annular bulges 21, the groove receiving (in detent relation) and stably positioning the finger edges 19*a* so that the fitment is maintained and firmly supported in upright condition by the adapter, while still being easily removable from the adapter. The latter merely requires endwise relative separation of the dispenser, as by pulling, from the adapter, the adapter fingers resiliently spreading as required to release the tubular dispenser. Also note in FIGS. 1 and 2 that the top of the fitment may be flatly engaged with the cap top wall underside, at 24, the adapter holding the fitment in position, whereby stability of the fitment is assured. Engagement at 24 assists in this.

The adapter also has an upper rim portion 21 that is annular, an is retained between the cap and the top portion of the bottleneck, as seen in FIG. 1. It may be simply lifted off the neck, when the cap is removed, to remove the adapter and dispenser fitment as a unit. Thereafter, the fitment may be quickly pulled free of the adapter, used, replaced into the adapter, and the latter re-seated on the bottle neck. The cap may then be replaced. If desired, the fitment may be left in the adapter, when it is in use.

The lower end of the fitment is shown as including a removable sub-cap 31 fitting the side wall of the tubular fitment at 31*a*. Removal of the sub-cap enables removal of its contents.

Opposite ends of the fitment may be capped as at 31 and 41, in FIG. 2*a*, whereby those caps may be removed, and the contents of the fitment removed, as by pushing a pre-spotter stick endwise in the fitment tube. A screw type pusher action is also contemplated.

FIG. 7 shows a fitment tube 16' of larger diameter $D_2'$ accepted by the adapter and resiliently held in position by the fitment fingers 19 which are spread further apart.

The fitment contents may for example consist of one of the following (i) a pre-spotter composition consisting essentially of one of the following:

(A)
- about 40% polyethoxylated nonylphenol
- about 30% ethoxylated alcohol
- about 29% polyethylene glycol
- about 1% enzyme (B)
- about 10% tetrachloroethylene
- about 15% ethoxylated alcohol
- about 70% hydrocarbon having 10–16 carbon atoms
- about 5% hydrocarbon propellant (C)
- about 20% ethoxylated alcohol
- about 15% ether sulfate
- about 2% enzyme
- q.s. water, perfume and dye (D) any of the stick compositions described in U.S. Pat. No. 3,953,353

(ii) a bleach activator that consists essentially of one of the following compositions I, II, III, IV, V, VI and VII, wherein ingredient weight percentages are about the same as those listed:

| | Weight | | | | | | |
|---|---|---|---|---|---|---|---|
| Ingredient | I | II | III | IV | V | VI | VII |
| Sodium Bromide | 100 | 50 | 20 | 20 | 60 | 75 | 40 |
| Sodium Chloride | — | 50 | 80 | 75 | 35 | — | 10 |
| Citric Acid | — | — | — | — | 3 | — | — |
| Sodium Bisulfate | — | — | — | — | — | 20 | — |
| Sodium Bicarbonate | — | — | — | — | 2 | — | — |
| Corn Starch | — | — | — | 5 | — | 5 | — |
| Water | — | — | — | — | — | — | 50 |

(iii) a chlorine release agent selected from the group consisting essentially of:

($x_1$) chlorinated trisodium phosphate ($x_2$) sodium dishlorocyanuarate (or hydrated form thereof)
($x_3$) potassium dichlorocyanurate
($x_4$) trichloroisocyanuric acid
($x_5$) 1,3 dichloro 5,5 dimethylhydantoin
($x_6$) N,N'-dichlorobenzoylene urea
($x_7$) N-dichlorobinuret
($x_8$) sodium hypochlorite
($x_9$) calcium hupochlorite
($x_{10}$) lithium hypochlorite (iv) a bleach activator that consists essentially of one of the following compositions I, II, III, IV, V, wherein ingredient weight percentages are about the same as those listed:

| | Weight % | | | | |
|---|---|---|---|---|---|
| | I | II | III | IV | V |
| Sodium bromide | 20.0 | 40.0 | 60.0 | 75.0 | — |
| Potassium bromide | — | — | — | — | 95.0 |
| Sodium chloride | 75.0 | 10.0 | 35.0 | — | — |
| Citric Acid | — | — | 3.0 | — | — |
| Sodium bicarbonate | — | — | 2.0 | — | — |
| Starch | 5.0 | — | — | 5.0 | 5.0 |
| Sodium bisulfate | — | — | — | 20.0 | — |
| Water | — | 50.0 | — | — | — |

I claim:

1. In combination with a fitment in the form of a closed dispenser adapted for storage in the neck of a container for a first composition, to dispense a second composition therein at the time access is gained to the container interior, for use in a cleaning process, the combination comprising (a) a cap configured to attach to the neck of the container, the neck having an uppermost top portion,
(b) the dispenser located within the cap to project within the neck interior and to be movable relative to the cap, and
(c) an adapter in the form of a holder into which the fitment dispenser is removably received, said adapter removably mounted on the container neck and suspending the dispenser within said neck,
(d) the adapter having an upper rim portion retained between the cap and said top portion of the neck, the adapter also having finger means projecting downwardly and inwardly about and toward the dispenser to slidably engage the side of the dispenser so that the dispenser is lengthwise slidably supported by the finger means, the adapter everywhere located above the bottom of the dispenser.

2. The combination of claim 1 wherein said adapter is generally annular and said fitment is tubular and has slidable and frictional interfit with the adapter.

3. The combination of claim 1 wherein said adapter finger means has multiple fingers which slidably interfit the dispenser.

4. The combination of claim 3 wherein the adapter has a frusto-conical portion defining said fingers, there being slits between the fingers.

5. The combination of claim 4 wherein the tubular fitment dispenser forms external annular grooving to receive edges of the fingers thereby to stabilize the fitment dispenser relative to the adapter.

6. The combination of claim 3 wherein the adapter extends generally vertically, and the adapter fingers project downwardly and toward and about the dispenser for slidable interfit therewith.

7. The combination of claim 1 wherein the top of the dispenser extends adjacent a top wall defined by the cap when the cap is secured on the neck, to assist in stabilization of the dispenser.

8. The combination of claim 1 wherein the dispenser is tubular, and has a closure at one end thereof to be removed for dispensing said second composition.

9. The combination of claim 8 the dispenser also has a removable closure at the opposite end thereof.

10. The combination of claim 8 wherein said second composition is selected from the following group of compositions:

(i) a pre-spotter composition
(ii) a bleach activator
(iii) available chlorine compound
(iv) bleach activator including halide salt.

* * * * *